United States Patent [19]

Simpson

[11] 4,069,691

[45] Jan. 24, 1978

[54] GARMENT HANGER LOCK DEVICE

[76] Inventor: Burnard W. Simpson, 1134 Inverness, Wichita, Kans. 67218

[21] Appl. No.: 772,867

[22] Filed: Feb. 28, 1977

[51] Int. Cl.[2] ..... E05B 73/00

[52] U.S. Cl. ..... 70/59; 211/4; 70/18

[58] Field of Search ..... 70/18, 59, 60, 61, 62; 211/4, 7, 8, 9; 312/216, 217, 219, 220

[56] References Cited

U.S. PATENT DOCUMENTS

| | | | |
|---|---|---|---|
| 2,438,783 | 3/1948 | Kraft | 211/4 |
| 2,616,133 | 11/1952 | Peters | 70/59 |
| 2,655,424 | 10/1953 | O'Connor | 211/4 |
| 3,211,408 | 10/1965 | Schaefer | 211/4 |
| 3,647,072 | 3/1972 | Strong | 211/4 |
| 3,690,130 | 9/1972 | Eutzler | 70/59 |

*Primary Examiner*—Robert L. Wolfe

*Attorney, Agent, or Firm*—Edwin H. Crabtree; John H. Wilddowson

[57] ABSTRACT

A garment hanger lock device for receiving a cable ring attached to the end of a cable. The cable threaded through a sleeve of a garment and attached to a garment hanger. The device disposed between garment display racks having garments displayed thereon. The device receiving a plurality of cable rings attached to the cables which are threaded through each of the garments thereby providing a pilfered proof means for preventing garments from being removed from the garment hangers without authorization.

6 Claims, 6 Drawing Figures

GARMENT HANGER LOCK DEVICE

BACKGROUND OF THE INVENTION

This invention relates generally to a device for preventing the pilfering of a garment from a garment hanger, and more particularly, but not by way of limitation, to a garment hanger device for securing the end of a cable ring attached to a cable which is threaded through the sleeve of the garment and attached to the garment hanger.

Heretofore, there have been various types of anti-theft security chains for attaching to the hanger of a garment. Also, there have been various types of chains attached to lockers and wardrobe boxes to prevent the unauthorized removal of clothing from the locker or wardrobe box.

In U.S. Pat. No. 3,690,130 to Eutzler, a device to prevent pilferage of merchandise is disclosed having a retainer box with a locked cover. The box has a row of pegs therein with a slotted front wall. A link at one end of a chain may be inserted through the slot in the front wall and over a peg in the box. When the cover is closed and the box is locked, the chain is secured inside the box. While this device secures one end of a chain attached to merchandise suspended on a hanger, the structure of the subject invention is clearly distinguishable from this device. Also, the device is limited in the number of chains it can receive in the box since only one chain can be received per slot in the front wall.

None of the prior art garment and hanger securing devices provide means for securing a large number of chains attached to garment hangers on display racks.

SUMMARY OF THE INVENTION

The subject garment hanger lock device can be disposed between rows of garment display racks for receiving a plurality of cable rings attached to the ends of cables. The cables are threaded through each of the sleeves of the garments and attached to the garment hangers. The device is adaptable for receiving a large number of cable rings so that all of the garments on the display racks may be secured.

The subject invention may be mounted horizontally or vertically on a support structure. The invention can also be mounted on a wall or horizontal surface.

The device prevents the unauthorized removal of garments from the garment hanger and provides means for quickly locking a cable ring attached to the end of a cable which is threaded through the sleeve of a garment and attached to the garment hanger. The subject invention is rugged in construction, is easy to operate, and is readily adaptable for using with a variety of different types of clothing which are hung on a hanger and suspended from a display rack.

The garment hanger lock device includes a horizontal base having a plurality of vertical elongated posts attached to the top of the base and extending upwardly therefrom. The posts receive a plurality of cable rings. The cable rings are attached to cables which are threaded through the sleeves of garments which are hung on garment hangers and suspended from display racks. Attached to the base is a vertical support. A cover having a hollow center portion is hingeably attached to the top of the support. When the cover is lowered to a horizontal position, apertures in the bottom of the cover receive the top portion of the posts. The hollow center portion of the cover receives a lock housing having a lock mounted therein. By activating the lock, the cover is secured thereto and the cable rings can not be removed from the device thereby preventing the unauthorized removal of the garment from the garment hanger.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
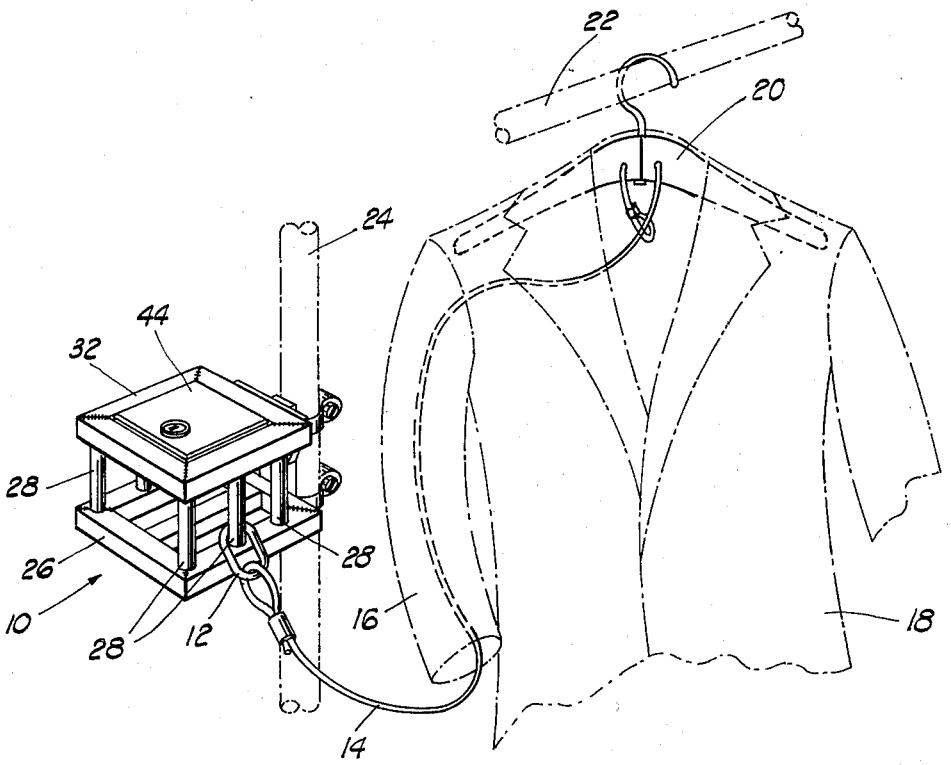
FIG. 1 is a perspective view of the garment hanger lock device mounted on a vertical support structure which is a portion of a display rack.

In FIG. 1, the garment hanger lock device is designated by general reference numeral 10. The device 10 receives a cable ring 12 which is attached to a cable 14 which is threaded through a sleeve 16 of a garment 18. The other end of the cable is attached to a hanger 20 which is used for hanging the garment 18 from a hanger rod 22 which is part of a display rack. The device 10 is attached to a portion of a vertical support structure 24, which in this illustration is a portion of the display rack.

Figure 2:
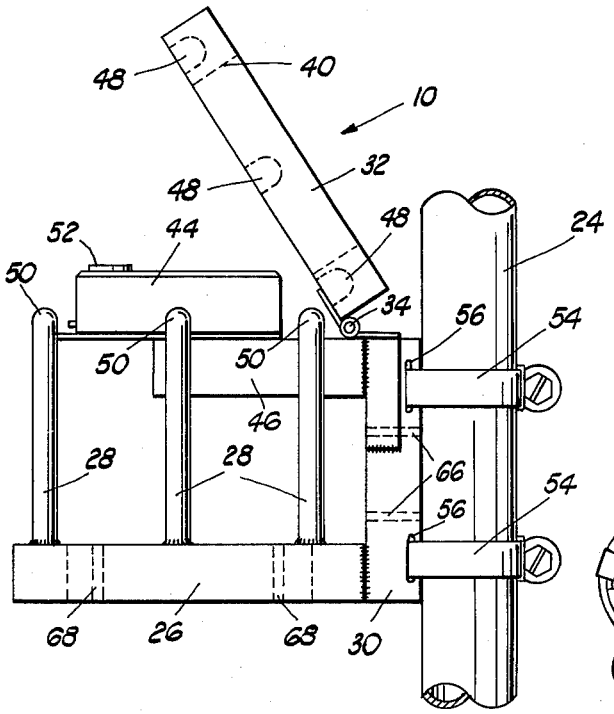
FIG. 2 is a side view of the device with the hingeable cover in an open position.

In FIG. 2, the device 10 is illustrated in an open position ready to receive the cable ring 12. While only one cable ring is shown in FIG. 1, it can be appreciated due to the structure of the device 10, a plurality of cable rings 12 may be received for securing all of the garments hung from a display rack. The device 10 includes a horizontal base 26 having vertical elongated posts 28 extending upwardly from the top of the base. As shown in FIG. 1, the posts 28 are disposed on both sides of the base 26. Also, the posts 28 may be mounted around the periphery of the base 26 or a configuration on top of the base 26. A vertical support 30 is attached to one end of the base and extends upwardly therefrom. Attached to the top of the vertical support 30 is a cover 32. A hinge 34 is attached to one end of the top of the vertical support 30 and the cover 32 so that the cover 32 can pivot on top of the vertical support 30. The cover 32 includes a hollow angular center portion 40 for receiving an angular shaped lock housing 44 which is mounted on top of a horizontal support 46 which extends outwardly from the top of the vertical support 30 and attached thereto. The cover 32 further includes apertures 48 in the bottom thereof for receiving top portions 50 of the elongated posts 28 when the cover 32 is lowered on the hinge 34 to a horizontal position.

The lock housing 44 includes a key lock 52 which when activated secures the cover 32 to the lock housing 44, thereby retaining the top portions 50 of the elongated posts 28 inside the hinged cover 32.

The device 10 can be seen attached to a portion of the vertical support structure 24 by a pair of straps 54 which are threaded through elongated slots 56 in the sides of the vertical support 30.

Figure 3:
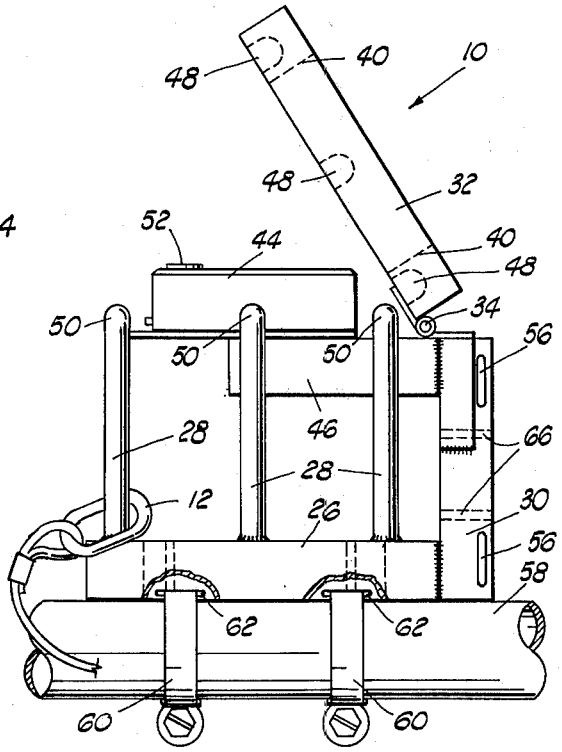
FIG. 3 is a side view of the device mounted on a horizontal support structure.

In FIG. 3, the device 10 is illustrated and is similar to the view illustrated in FIG. 2 except the device 10 is mounted horizontally on top of a horizontal support member 68 by a pair of straps 60 threaded through elongated slots 62 in the bottom of the base 26. In this view, a cable ring 12 is shown disposed around one of the vertical elongated posts 28.

Figure 4:
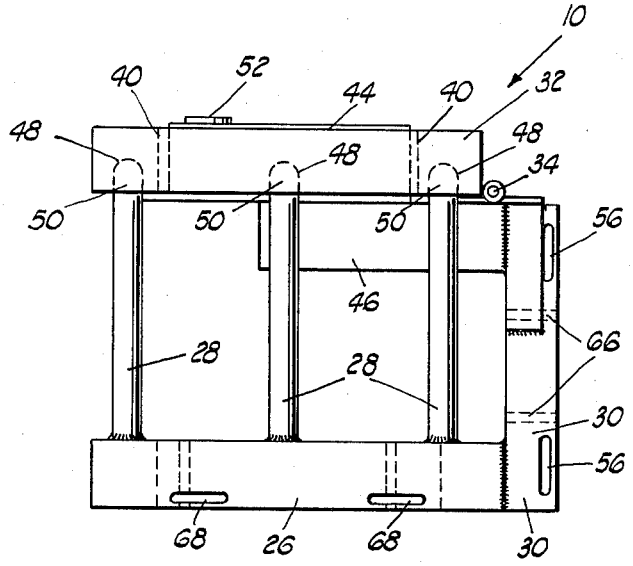
FIG. 4 is a side view of the device with the cover in a closed and locked position.

In FIG. 4, a side view of the device 10 is illustrated with the cover 32 lowered into a horizontal position and locked in position by the key lock 52. In this view, the top portions 50 of the elongated posts 48 are seen in dotted lines and are secured in the apertures 48 in the bottom of cover 32.

Figure 5:
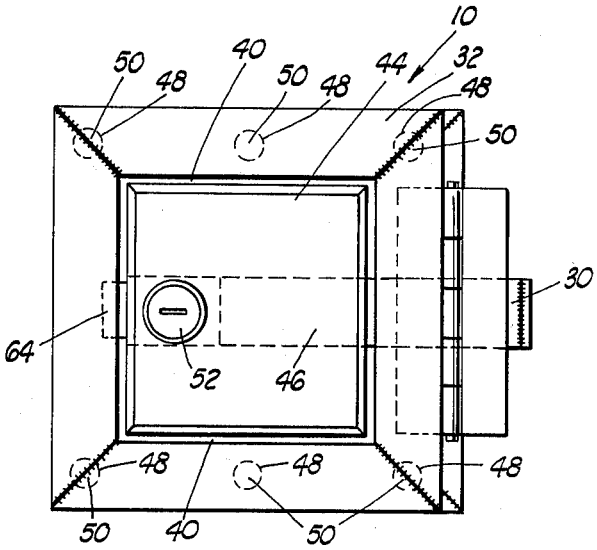
FIG. 5 is a top view of the device.

In FIG. 5, a top view of the device 10 is illustrated. In this view, the angular shape of the cover 32 can be seen with the angular shaped hollow center portion 40 receiving the angular shaped lock housing 44. Also in this view, the key lock 52 can be seen which when activated, releases a lock bar 64 shown in dotted lines which extends outwardly and is received in a portion of the cover 32 for securing the cover 32 to the top portions 50 of the elongated posts 28. Also seen in dotted lines, is the horizontal support 46 for holding the lock housing 44 in a horizontal position and attached to the vertical support 30 which is attached to one end of the base 26.

Figure 6:
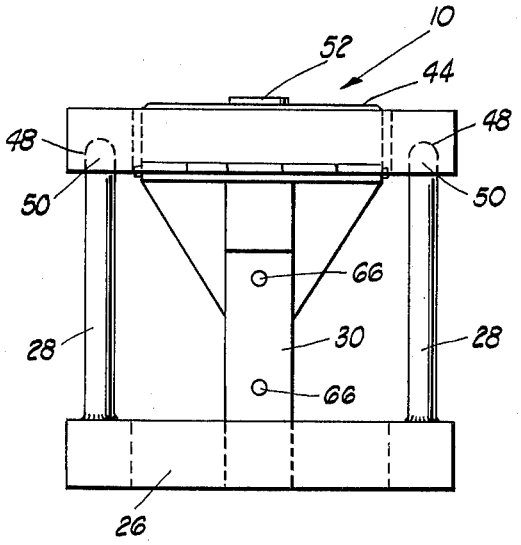
FIG. 6 is a rear view of the device.

In FIG. 6, a rear view of the device 10 is shown illustrating apertures 66 through the vertical support 30. These apertures 66 may be used for receiving threaded screws for mounting the device on a vertical wall rather than using straps 54 for securing the device 10 as shown in FIG. 2. Also shown in FIG. 2 through 4 are apertures 68 indicated by dotted lines through the base 26 for receiving threaded screws for securing the device 10 to a horizontal surface such as a table or the like rather than using the clamps 60 as discussed under FIG. 3. While the clamps 54 and 60 and threaded screws are discussed, it can be appreciated that any type of securing means may be used for mounting the device 10 to a horizontal or vertical structure.

In operation, the device 10 is positioned between display racks so that the device 10 can receive a plurality of cable rings 12. When the garment 18 is suspended from the hanger 20 on a display rack, the cable 14 attached to the hanger 20 is threaded through the sleeve 16 of the garment 18 and the cable ring 12 is inserted over the top portion 50 of the vertical elongated posts 28. As many cable rings 12 as there are garments 18 may be inserted around the plurality of posts 28. When all of the cable rings 12 are received, the hinged cover 32 is lowered to a horizontal position and a key is inserted into the key lock 52. The lock 52 is then actuated securing the cover 32 to the lock housing 44 and the top portions 50 of the elongated posts 28. Not until the key lock 52 is unlocked and the cover 32 is opened, can the cable rings 12 be removed so that the garment 18 can be removed from the garment hanger 18.

Changes may be made in the construction and arrangement of the parts or elements of the embodiment as disclosed herein without departing from the spirit or scope of the invention as defined in the following claims.

I claim:

1. A garment hanger lock device, the device receiving a cable ring attached to the end of a cable, the cable threaded through the sleeve of a garment and attached to a garment hanger, the device comprising:

a horizontal base;

a plurality of vertical elongated posts attached to the top of said base and extending upwardly therefrom, said posts receiving the cable ring therearound;

a vertical support attached to said base and extending upwardly therefrom;

a cover having a hollow center portion, said cover hingeably attached to the top of said vertical support, said cover having apertures therein for receiving the top portions of said posts when said cover is lowered to a horizontal position; and lock means attached to said vertical support and received in the hollow center portion of said cover when said cover is lowered to a horizontal position, said lock means for securing said cover to the top portions of said posts and preventing the cable ring from being removed therefrom.

2. The device as described in claim 1, wherein said lock means includes a horizontal lock support attached to the top of said vertical support, a lock housing attached to and disposed on top of said horizontal lock support, and said lock disposed in said lock housing, said lock when activated securing said cover thereto.

3. The device as described in claim 1, further including horizontal attachment means for securing the device to a horizontal support structure.

4. The device as described in claim 1, further including vertical attachment means for securing the device to a vertical support structure.

5. A garment hanger lock device, the device receiving a cable ring attached to the end of the cable, the cable threaded through the sleeve of a garment and attached to a garment hanger, the device comprising:

an angular shaped horizontal base;

a plurality of vertical elongated posts attached to the top of said base and in a spaced relationship to each other, said posts extending upwardly from the top of said base for receiving the cable ring therearound;

a vertical support attached to one end of said base and extending upwardly therefrom;

an angular shaped cover having substantially the same dimensions as said base and having a hollow center portion, said cover disposed above and in a spaced relationship from said base, said cover having one end hingeably attached to the top of said support, said cover having apertures in the bottom thereof for receiving the top portions of said posts when said cover is lowered to a horizontal position;

a horizontal lock support attached to the top of said vertical support;

a lock housing attached to and disposed on top of said horizontal lock support, said lock housing received in the hollow center portion of said cover when said cover is lowered into a horizontal position; and a lock disposed in said lock housing and when activated securing said cover to the top portions of said posts to prevent the cable ring from being removed therefrom.

6. The device as described in claim 5, wherein the hollow center portion of said cover is angular in shape for receiving an angular shaped lock housing therein when said cover is lowered into a horizontal position.

* * * * *